US010945517B1

(12) United States Patent
Gilbar et al.

(10) Patent No.: US 10,945,517 B1
(45) Date of Patent: Mar. 16, 2021

(54) PORTABLE REUSABLE BEVERAGE BOTTLE WITH DRINKING CUP

(71) Applicant: Remaker Labs, Inc., Santa Barbara, CA (US)

(72) Inventors: Sky Gilbar, Santa Barbara, CA (US); John Stump, Santa Barbara, CA (US)

( * ) Notice: Subject to any disclaimer, the term of this patent is extended or adjusted under 35 U.S.C. 154(b) by 0 days.

(21) Appl. No.: 16/446,455

(22) Filed: Jun. 19, 2019

(51) Int. Cl.

| | |
|---|---|
| ***A45F 3/18*** | (2006.01) |
| ***B65D 23/12*** | (2006.01) |
| ***B65D 21/02*** | (2006.01) |
| ***B65D 43/02*** | (2006.01) |
| ***A47G 19/22*** | (2006.01) |

(52) U.S. Cl.
CPC ..... *A45F 3/18* (2013.01); *A47G 19/2205* (2013.01); *B65D 21/0233* (2013.01); *B65D 23/12* (2013.01); *B65D 43/0229* (2013.01)

(58) Field of Classification Search
CPC ..... A45F 3/00–18; A47G 19/00–2205; B65D 43/00–0229; B65D 23/00–12; B65D 21/00–023; B65D 85/1054; B65D 5/6602; B65D 5/001; B65D 21/02; B65D 85/62; B65D 5/005; B65D 21/0201; B65D 21/0209; B65D 21/0235; B65D 21/043; B65D 23/0885
USPC ..... 220/737–742, 23.83, 23.86, 23.87, 4.26
See application file for complete search history.

(56) References Cited

U.S. PATENT DOCUMENTS

| | | | | |
|---|---|---|---|---|
| 3,015,403 | A * | 1/1962 | Fuller | A47J 41/0011 222/563 |
| 5,406,808 | A * | 4/1995 | Babb | A47J 41/0005 220/379 |
| 5,987,913 | A * | 11/1999 | Andrzejczak | A47G 19/02 215/12.1 |
| 8,621,885 | B1 * | 1/2014 | Niebolte | F25D 31/002 62/457.4 |
| 2013/0240549 | A1 * | 9/2013 | Beggins | B65D 21/086 220/739 |
| 2015/0090711 | A1 * | 4/2015 | Peterson | A61J 9/0669 220/4.07 |
| 2015/0253055 | A1 * | 9/2015 | Tsui | B62B 5/066 62/62 |
| 2018/0099781 | A1 * | 4/2018 | McConnell | B65D 21/0217 |
| 2018/0208361 | A1 * | 7/2018 | Klein | B65D 21/0231 |

* cited by examiner

*Primary Examiner* — Kareen K Thomas
(74) *Attorney, Agent, or Firm* — Patent Service Associates; Lyman Smith

(57) ABSTRACT

A beverage container system can include a reusable beverage bottle, such as a water bottle, and a reusable beverage cup that can nest with the beverage bottle, inside a sleeve that attaches to the beverage bottle, when not in use. A beverage bottle cap can include a storage region for storing a cup cap that fits onto the beverage cup when it is removed from its nested, or stowed, configuration. From the stowed configuration, the user can twist a collet to permit removal of the beverage cup. After filled, the cup cap may be placed over the cup to prevent leakage or spillage and permit the user to access the contents. The cup may be placed, bottom side first, into the sleeve and the collet activated to connect the cup with the bottle, where a user may access each by accessing either end of the assembly.

17 Claims, 21 Drawing Sheets

PORTABLE REUSABLE BEVERAGE BOTTLE WITH DRINKING CUP

BACKGROUND OF THE INVENTION

1. Field of the Invention

Embodiments of the invention relates generally to beverage containers. More particularly, the invention relates to a portable, reusable beverage bottle, such as a water bottle, having a drinking cup that stores nested with the beverage bottle and is readily deployed and stowed as needed.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Conventionally, if a user purchases a beverage, such as coffee, they use a paper cup with a plastic lid. Such containers are extremely convenient and inexpensive, so their use can be determined at over 100 million of them every day in the United States. Almost all of these cups are coated in plastic, and 98% of them end up in landfills. Most people would prefer to use a reusable cup whenever practical, but they just don't find it convenient to carry one around.

Reusable water bottles have become increasingly popular. In efforts to reduce plastic bottle waste, people have converted to using such water bottles and often carry them around. However, when a person wants to purchase a beverage, such as coffee, they now have to carry around both their coffee cups as well as their water bottles in two separate containers.

In view of the foregoing, there is a need for a water bottle that can include a beverage cup in a single combined unit.

SUMMARY OF THE INVENTION

Embodiments of the present invention provide a container system comprising a bottle having an upper portion with an opening to access an interior thereof, and a lower portion extending from the upper portion, the lower portion having an outer diameter; a sleeve attached to the bottle and extending about at least the lower portion of the bottle; a space formed between the sleeve and the lower portion of the bottle; and a cup having an open end configured to receive at least a portion of the lower portion of the bottle to create a nested, stowed configuration, wherein, in the nested, stowed configuration, at least a portion of the cup is removably secured in the space.

Embodiments of the present invention further provide a container system comprising a bottle having an upper portion with an opening to access an interior thereof, and a lower portion extending from the upper portion, the lower portion having an outer diameter; a sleeve attached to the bottle and extending about at least the lower portion of the bottle; a bottle cap removably secured on the bottle to cover the opening thereof; a space formed between the sleeve and the lower portion of the bottle; a cup having an open end configured to receive at least a portion of the lower portion of the bottle to create a nested, stowed configuration, wherein, in the nested, stowed configuration, at least a portion of the cup is removably secured in the space; a cup cap removably fixed to the bottle cap in the nested, stowed configuration and removable from the bottle cap, without requiring the bottle cap to be removed from the bottle, to cover the cup when the cup is un-nested from the bottle; and an attachment member configured to retain the cup in the nested, stowed configuration.

Embodiments of the present invention also provide a container system transformable between a stowed, nested configuration, and at least one deployed configuration, the container system comprising a bottle having an upper portion with an opening to access an interior thereof, and a lower portion extending from the upper portion, the lower portion having an outer diameter; a sleeve attached to the bottle and extending about at least the lower portion of the bottle; a bottle cap removably secured on the bottle to cover the opening thereof; a space formed between the sleeve and the lower portion of the bottle; a cup having an open end configured to receive at least a portion of the lower portion of the bottle to create the nested, stowed configuration, wherein, in the nested, stowed configuration, at least a portion of the cup is removably secured in the space and surrounded by the sleeve; a cup cap removably fixed to the bottle cap in the nested, stowed configuration and removable from the bottle cap, without requiring the bottle cap to be removed from the bottle, to cover the cup when the cup is un-nested from the bottle; and an attachment member configured to retain the cup in the nested, stowed configuration, wherein a first deployed configuration is created by removably attaching a bottom portion of the cup with a top portion of the bottle cap after removing the cup cap therefrom; and a second deployed configuration is created by inserting the bottom portion of the cup into a lower end of the sleeve and actuating the attachment member to secure the bottom portion of the cup to the lower end of the sleeve.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
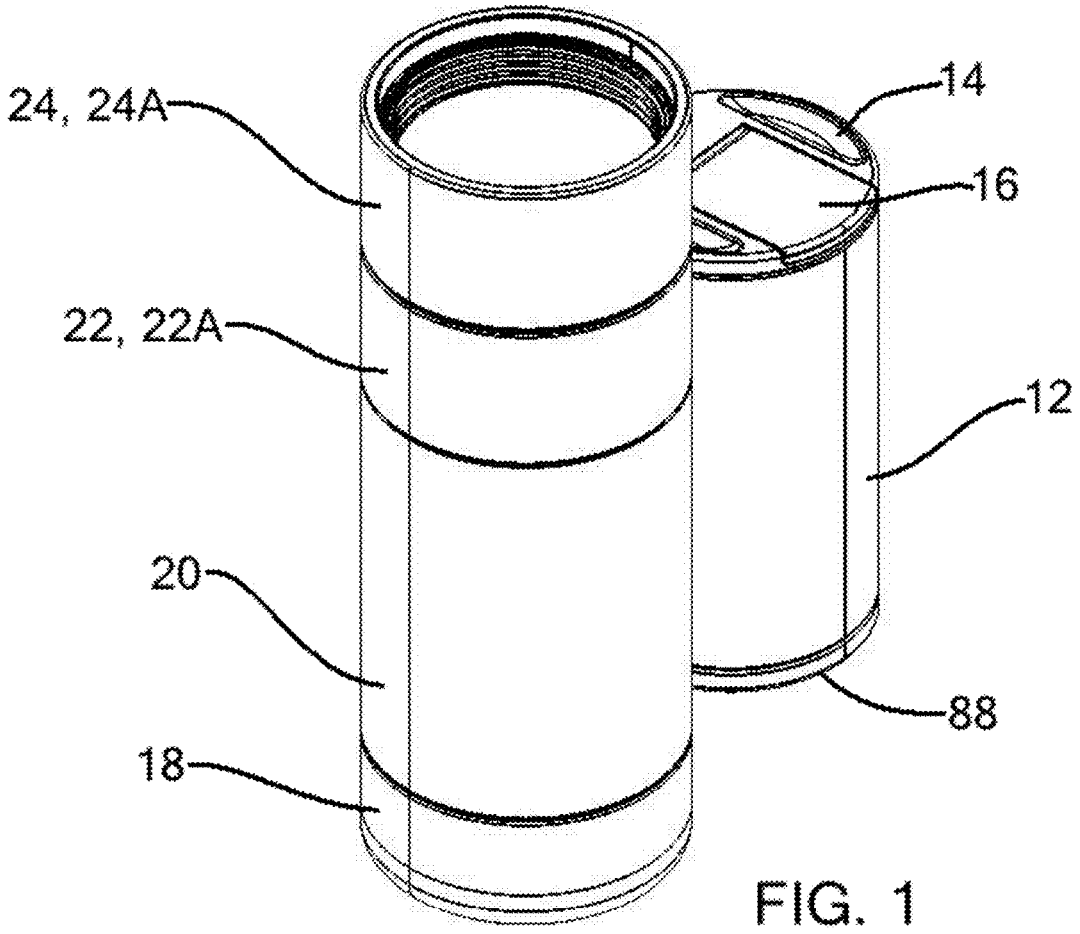
FIG. 1 illustrates a perspective view of a reusable beverage bottle and cup set, with the cup in a deployed state, according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a beverage container system that includes a reusable beverage bottle, such as a water bottle, and a reusable beverage cup that can nest with the beverage bottle, inside a sleeve that attaches to the beverage bottle, when not in use. A beverage bottle cap can include a storage region for storing a cup cap that fits onto the beverage cup when it is removed from its nested, or stowed, configuration. From the stowed configuration, the user can twist a collet to permit removal of the beverage cup. After filled, the cup cap may be placed over the cup to prevent leakage or spillage and permit the user to access the contents. The cup may be placed, bottom side first, into the sleeve and the collet activated to connect the cup with the bottle, where a user may access each container by accessing either end of the assembly.

In some embodiments, the cup may be placed onto the top of the bottle cap to secure the cup and bottle as a single unit, permitting the user to drink from the cup through the cup lid, or drink from the bottle after removing the bottle cap.

A base of the cup may include electronics that may be used, for example, as an external battery charger for electronic devices.

These and other embodiments of the present invention are discussed in greater detail in the following paragraphs.

Figure 2:
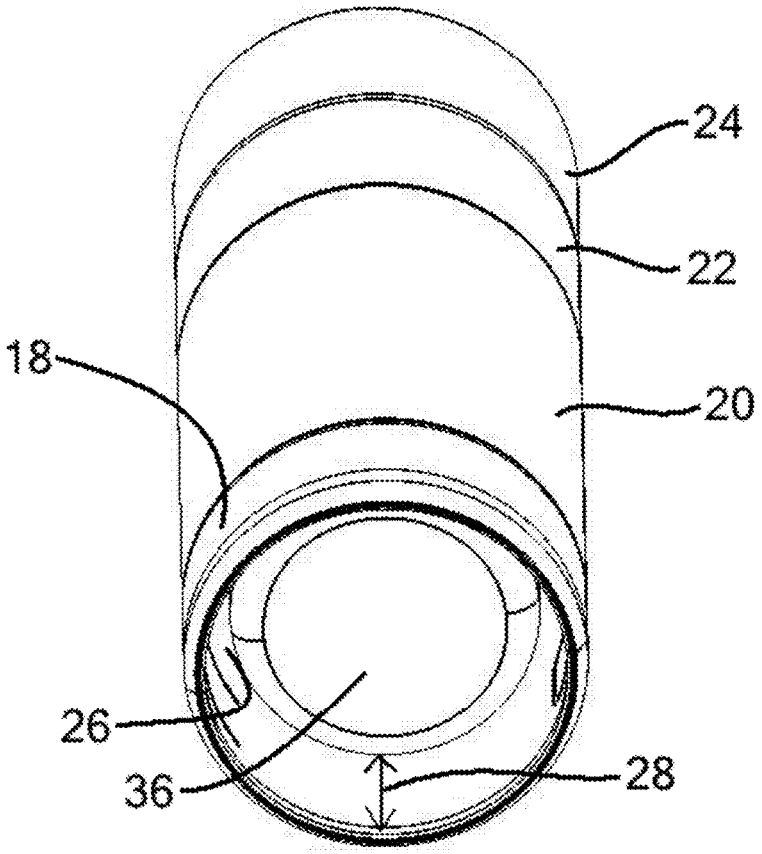
FIG. 2 illustrates a bottom view of the beverage bottle, showing a space for receiving the cup therein.

Referring to FIGS. 1 and 2, a beverage container system 10 (also referred to as system 10) can include a cup 12 (also referred to as a mug 12) having a cup cap 14 with a lid 16. The lid 16 may be movable to permit the user to access to contents within the cup 12. A bottom member 88, as discussed in greater detail below, may fit onto a bottom portion of the cup 12.

The system 10 can further include a beverage bottle 22, 22A (also referred to as water bottle 22, 22A or simply bottle 22, 22A) having a bottle cap 24, 24A disposed over an open end thereof. A sleeve 20 may fit over an outside of the bottle 22, 22A and an attachment mechanism 18, such as a collet, may be disposed about the bottom of the sleeve 20. As shown in FIG. 2, at least a lower portion of the bottle 22, 22A may have an outside diameter smaller than an inside diameter of the sleeve 20 such that a space 26 is formed therebetween. Further, as shown in FIG. 2, a depth 28 may be present between the bottom 36 of the bottle 22, 22A and the bottom of the sleeve 20.

Figure 3:
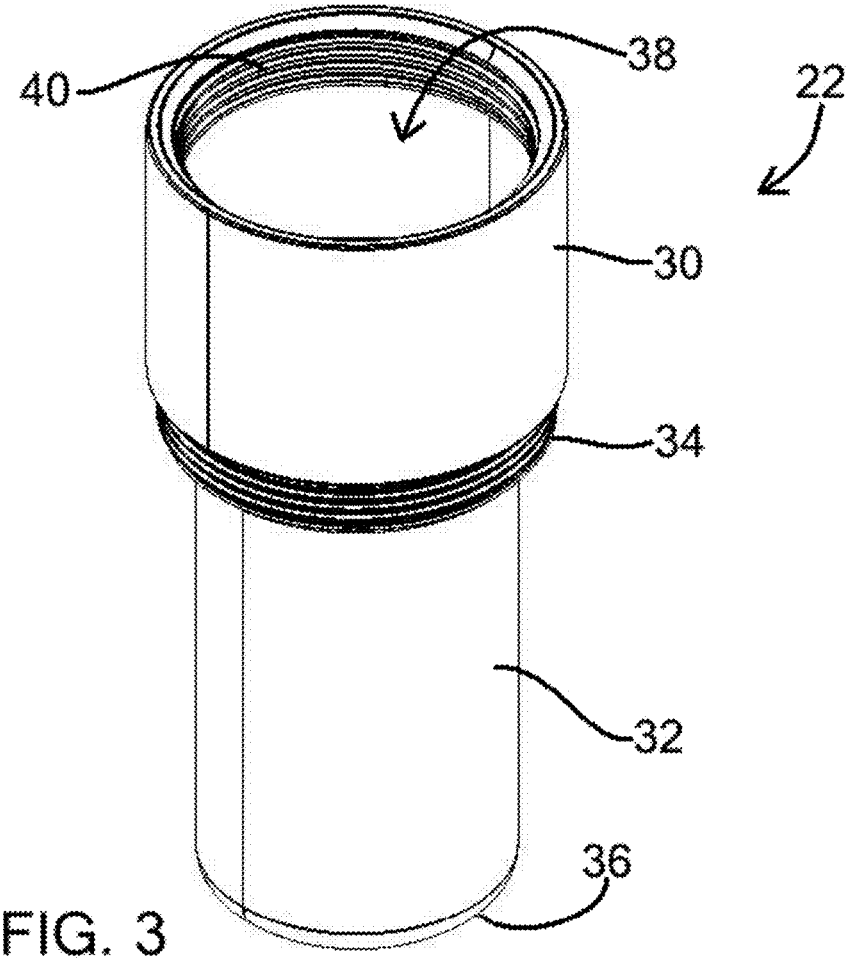
FIG. 3 illustrates a perspective view of the beverage bottle of FIG. 1, removed from its sleeve and bottle cap.
Figure 4:
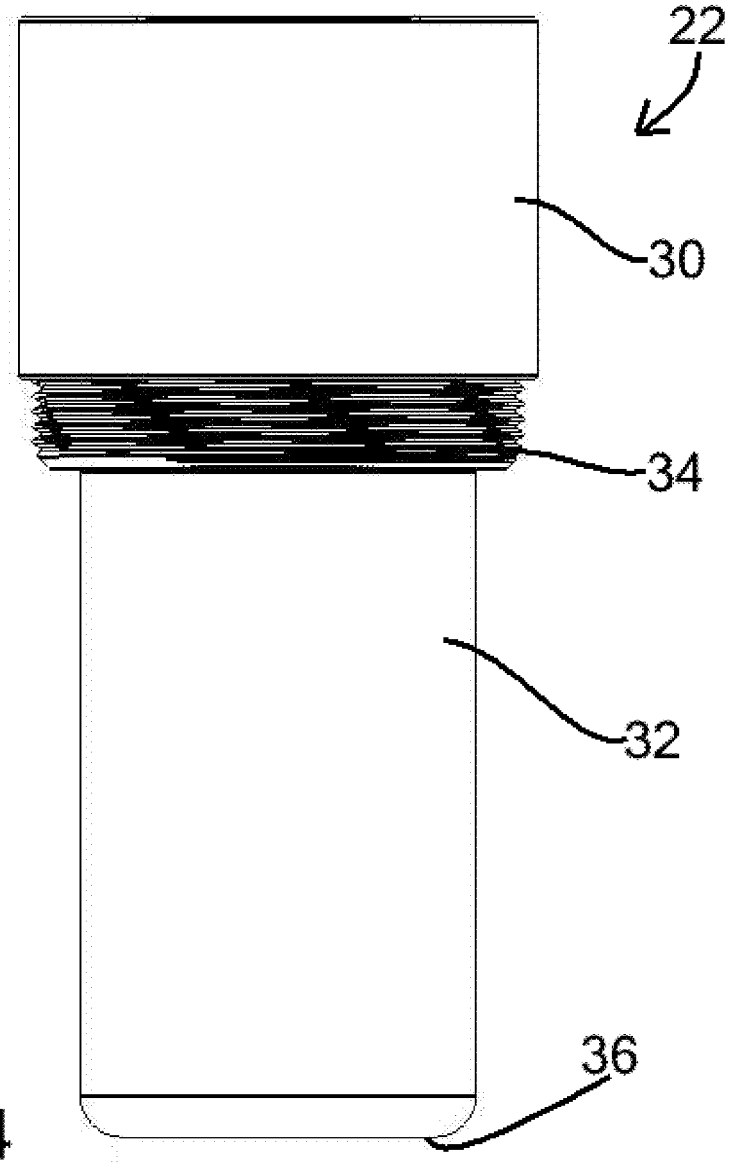
FIG. 4 illustrates a side view of the beverage bottle of FIG. 1, removed from its sleeve and bottle cap.

Referring to FIGS. 3 and 4, the bottle 22 is shown in detail. The bottle 22 can include an upper portion 30 having an outer diameter that is larger than an outer diameter of a lower portion 32 thereof. The bottle 22 can have an open top 38 and a closed bottom 36. Male threads 34 may be disposed on a lower, first end of the upper portion 30, where female threads 40 may be disposed in an upper, second end of the upper portion 30. As discussed in greater detail below, the male threads 34 may permit engagement of the bottle 20 to the sleeve 20. The female threads 40 may permit engagement of the bottle 20 with a bottle cap 24.

Figure 5:
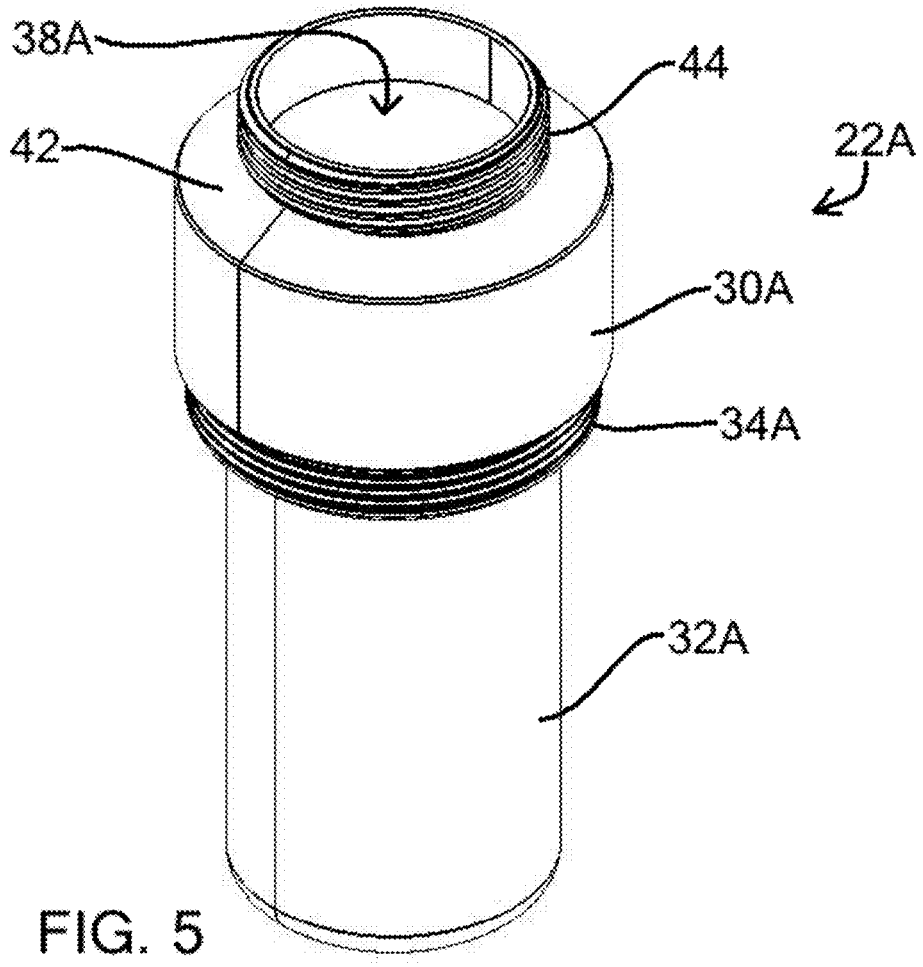
FIG. 5 illustrates an alternate embodiment of the beverage bottle of FIG. 1, having a reduced diameter upper opening, removed from its sleeve and bottle cap.
Figure 6:
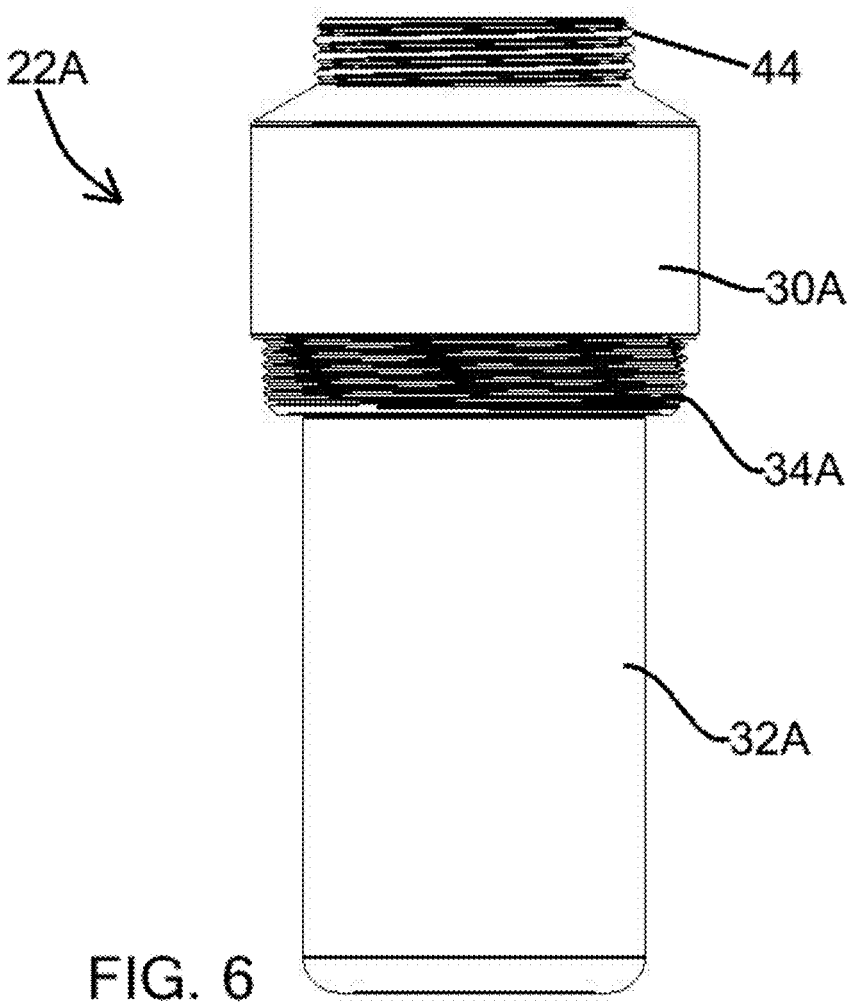
FIG. 6 illustrates a side view of the beverage bottle of FIG. 5.

Referring to FIGS. 5 and 6, an alternate embodiment of the bottle 22A is shown. The bottle 22A may be similar to the bottle 22, except that the upper, second end of an upper portion 30A thereof, may included a sloped surface 42 that reduces the diameter of the bottle 22A to terminate in male threads 44 formed about a top opening 38A of the bottle 22A. Similar to bottle 22, the bottle 22A can include male threads 34A at a lower, first end of the upper portion 30A and a lower portion 32A having a reduced diameter as compared to the upper portion 30A.

For both bottle 22 and bottle 22A, the lower portion 32, 32A may have a reduced diameter configured to receive the cup 12 in a nesting configuration. In other words, as discussed in greater detail below, the lower portion 32, 32A may be inserted into the open end of the cup 12 for storage thereof.

Figure 7:
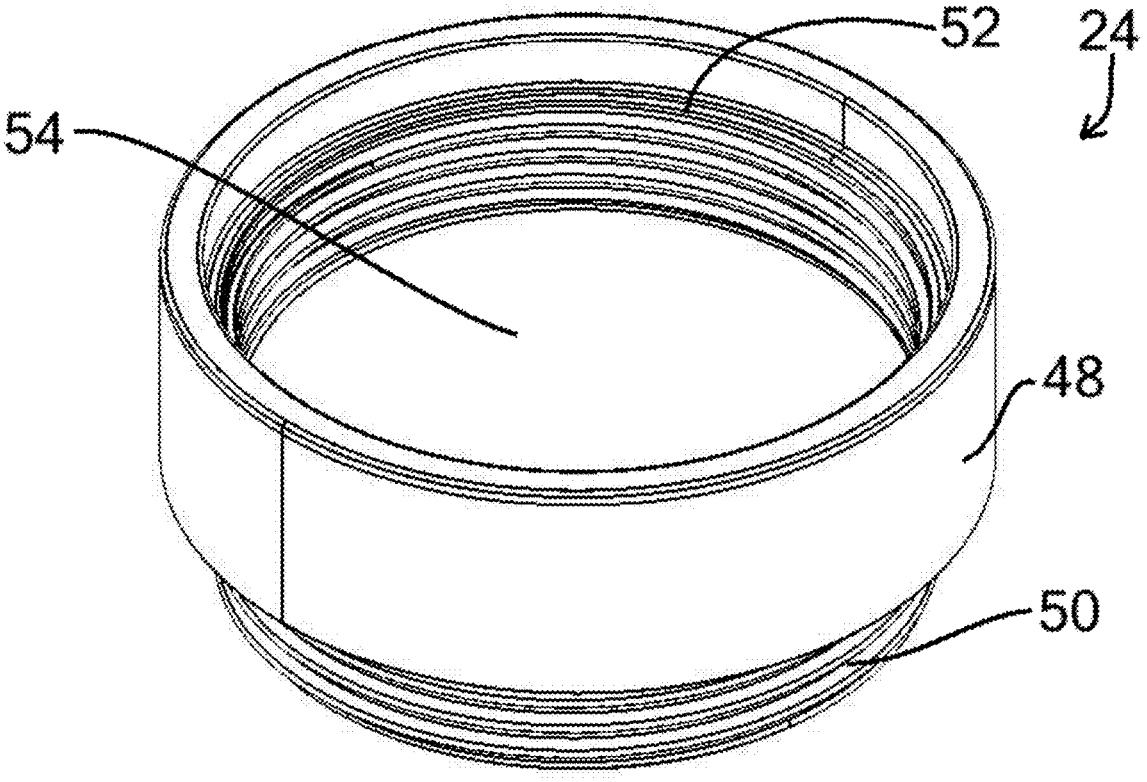
FIG. 7 illustrates a perspective view of a bottle cap configured to fit over an upper opening of the beverage bottle of FIG. 3.

Referring to FIG. 7, a bottle cap 24 can include male threads 50 that can mate with the female threads 40 of the bottle 22, where the bottle cap 24 can prevent leakage of contents from within the bottle 22 when the bottle cap 24 is disposed on the bottle 22. The bottle cap 24 can include an interior surface 54 that can seal over the open top 38 of the bottle 22. While the interior surface 54 is shown as a flat sealing surface, in some embodiments, a fluid access mechanism may be employed as part of the bottle cap 24. For example, a flip spout may be disposed in the interior surface 54 to permit a user to flip up the spout to access contents of the bottle 22 without having to remove the bottle cap 24.

The bottle cap 24 can include female threads 52 configured to receive a cup cap 14 therein, as discussed in greater detail below. An exterior 48 of the bottle cap 24 may be sized to match the exterior size of the upper portion 30 of the bottle 22 (which is exposed when the system 10 is assembled) as well as the exterior size of the sleeve 20, as shown in FIG. 1, where a continuous, uniform outer diameter may be provided for the system 10.

Figure 8:
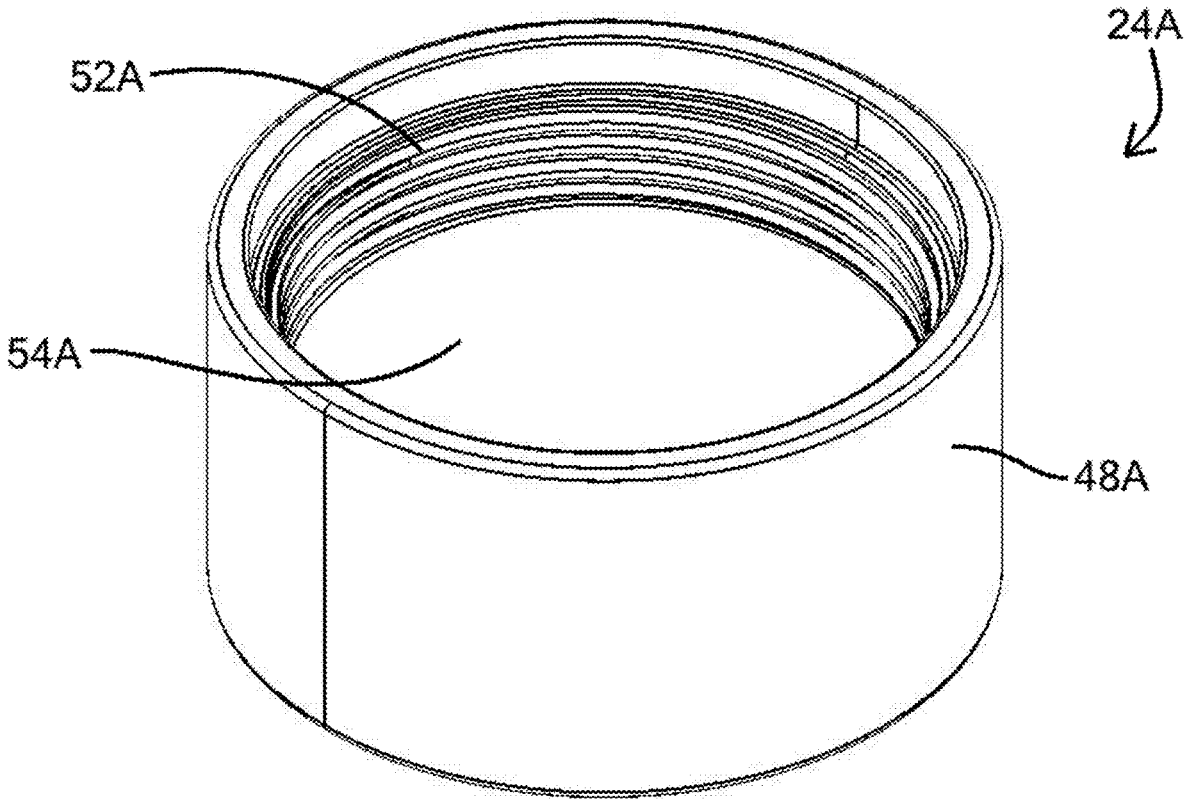
FIG. 8 illustrates a perspective view of a bottle cap configured to fit over an upper opening of the beverage bottle of FIG. 5.
Figure 9:
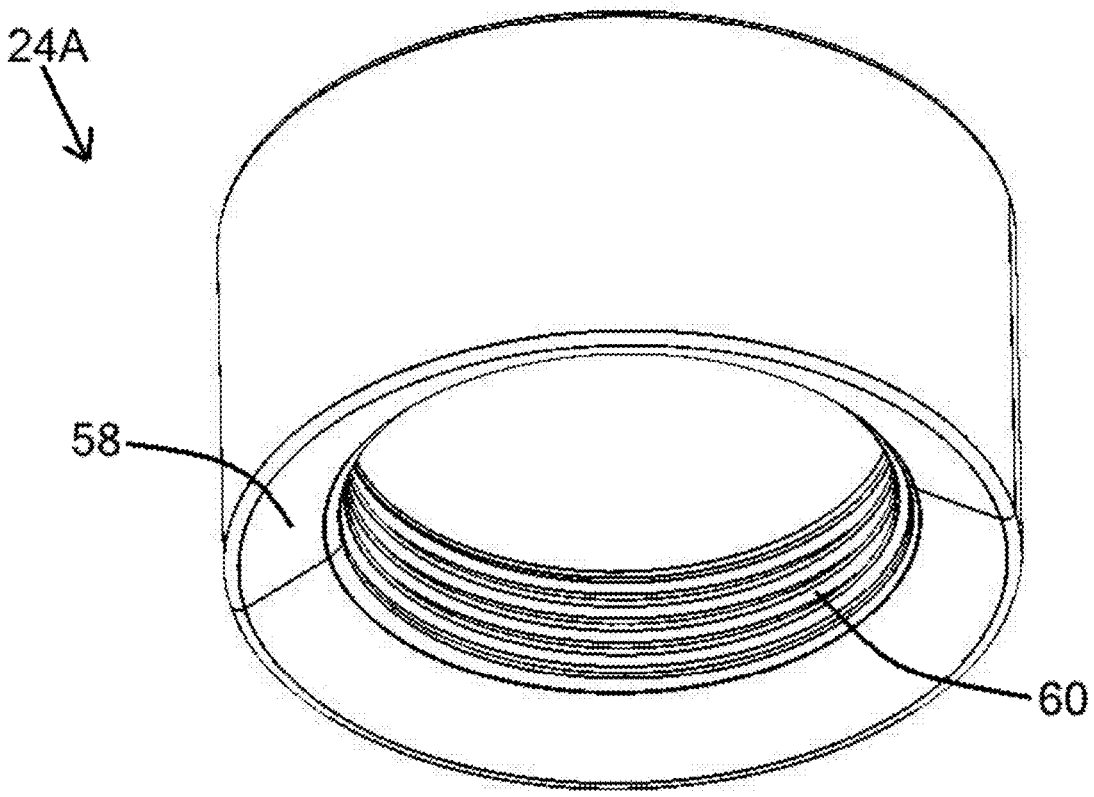
FIG. 9 illustrates a bottom perspective view of the bottle cap of FIG. 8.

Referring to FIGS. 8 and 9, a bottle cap 24A may be used with the bottle 22A, where the bottle cap includes lower female threads 60 that can mate with the male threads 44 about the open top 38A of the bottle 22A. Thus, the bottle cap 24A may be threaded onto the top of the bottle 22A to prevent leakage of contents from the bottle 22A. The bottle cap 24A can include an interior surface 54A that can seal over the open top 38A of the bottle 22A. While the interior surface 54A is shown as a flat sealing surface, in some embodiments, a fluid access mechanism may be employed as part of the bottle cap 24A. For example, a flip spout may be disposed in the interior surface 54A to permit a user to flip up the spout to access contents of the bottle 22A without having to remove the bottle cap 24A. A bottom surface 58 of the bottle cap 24A may be sloped to match the sloped surface 42 of the bottle 22A.

Similar to the bottle cap 24, an exterior 48A of the bottle cap 24A may be sized to match the exterior size of the upper portion 30A of the bottle 22A (which is exposed when the system 10 is assembled) as well as the exterior size of the sleeve 20, as shown in FIG. 1, where a continuous, uniform outer diameter may be provided for the system 10.

Figure 10:
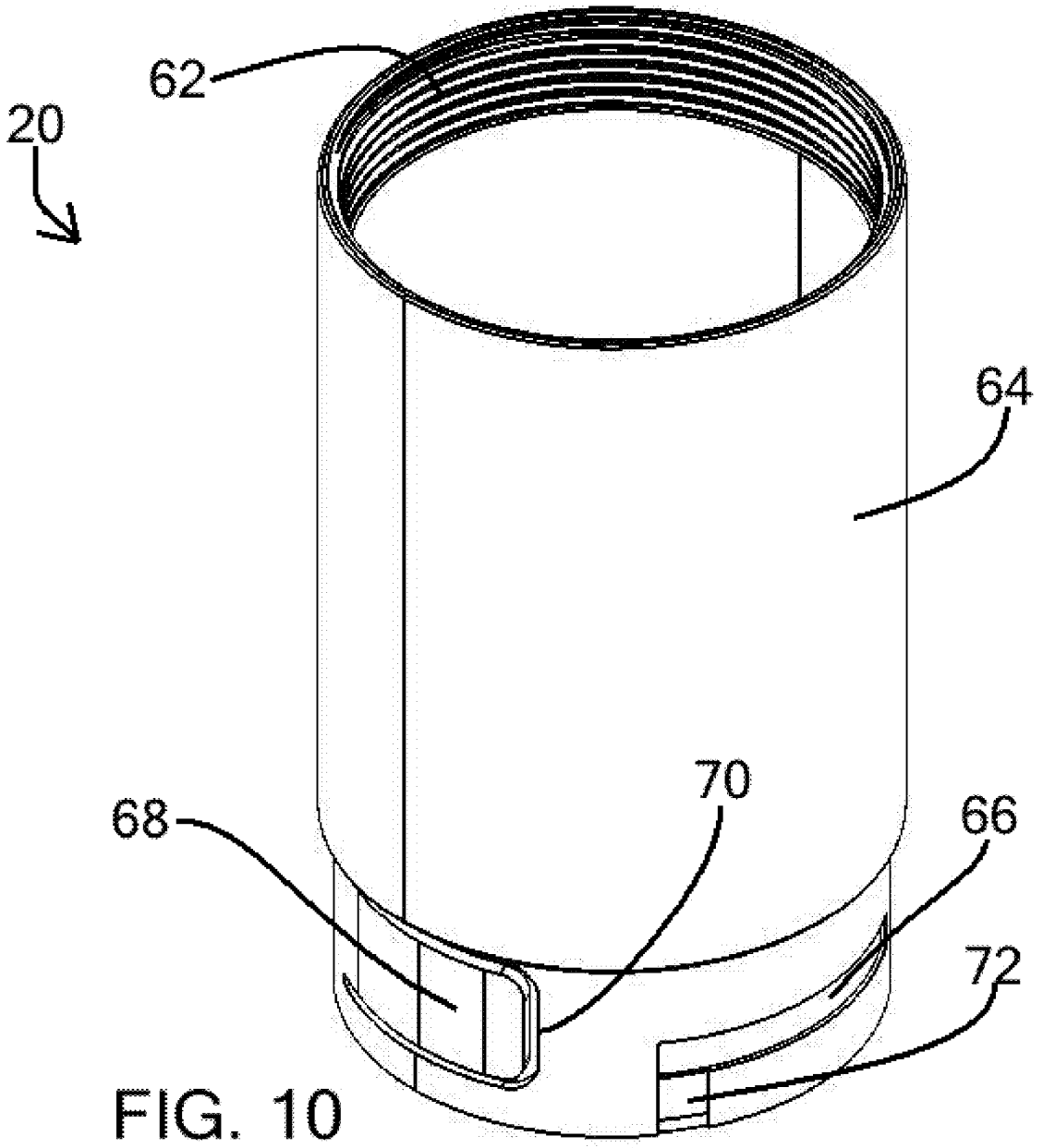
FIG. 10 illustrates a perspective view of a sleeve adapted to fit over a portion of the beverage bottle.
Figure 11:
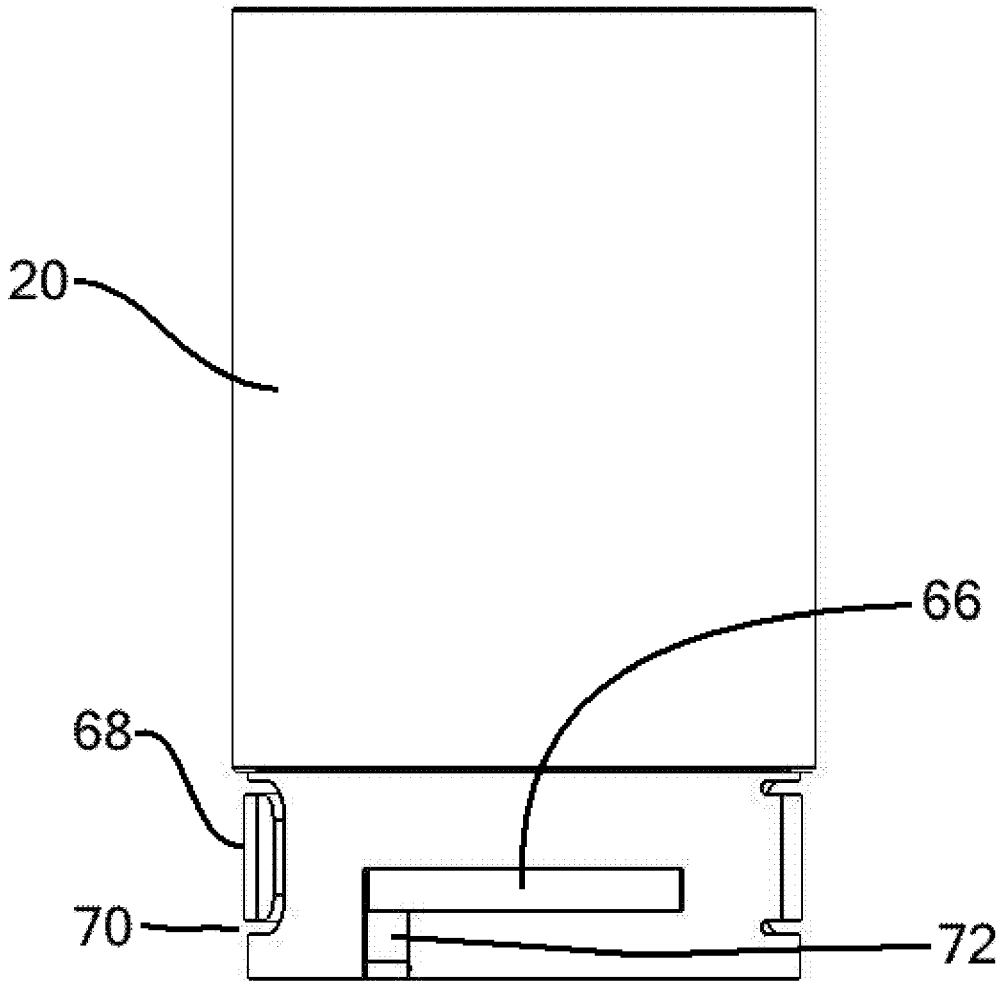
FIG. 11 illustrates a side view of the sleeve of FIG. 10.

Referring now to FIGS. 10 and 11, an exemplary embodiment of the sleeve 20 is shown. The sleeve can include female threads 62 can mate with the male threads 34, 34A on the bottle 22, 22A, permitting removable attachment thereto. The outer surface 64 of the sleeve 20 may extend to cover the lower portion 32, 32A of the bottle 22, 22A when assembled therewith.

Figure 12:
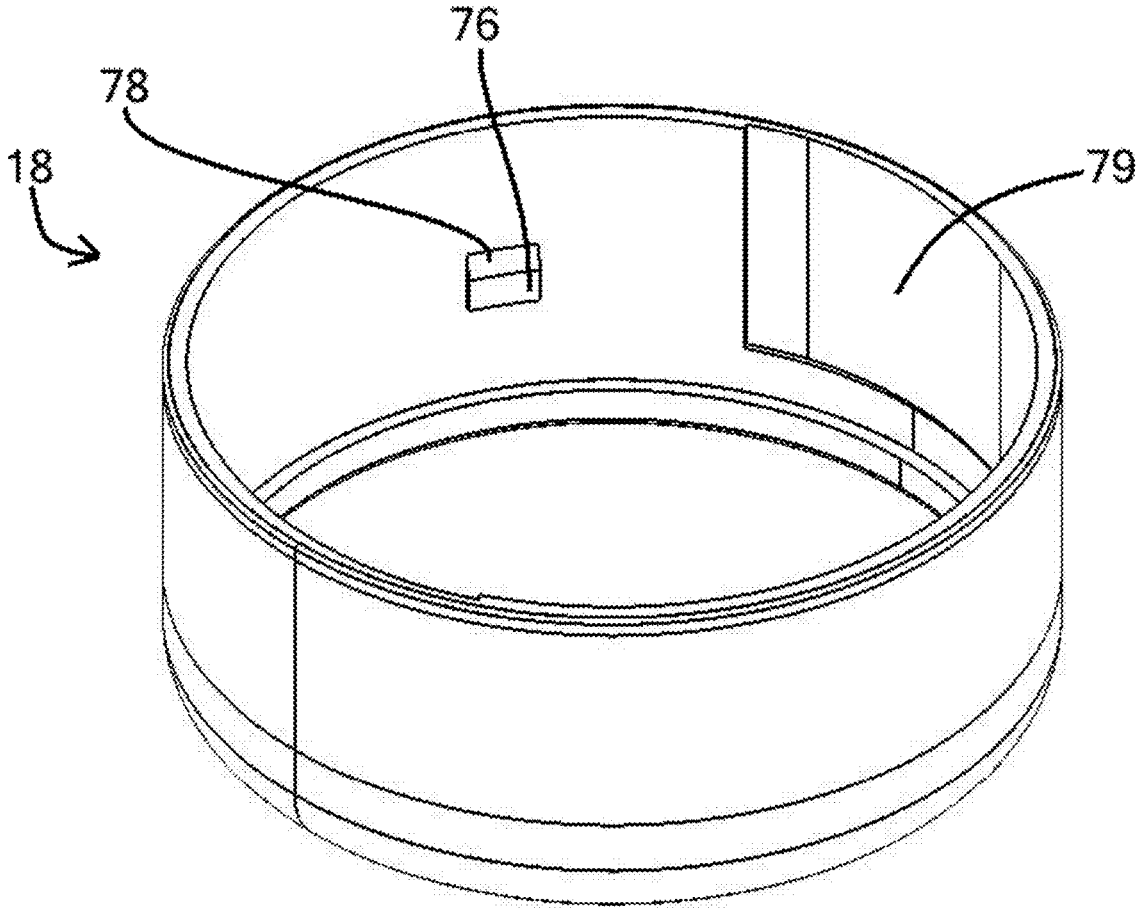
FIG. 12 illustrates a perspective view of a collet at least partially rotatable about a bottom of the sleeve of FIG. 10.
Figure 13:
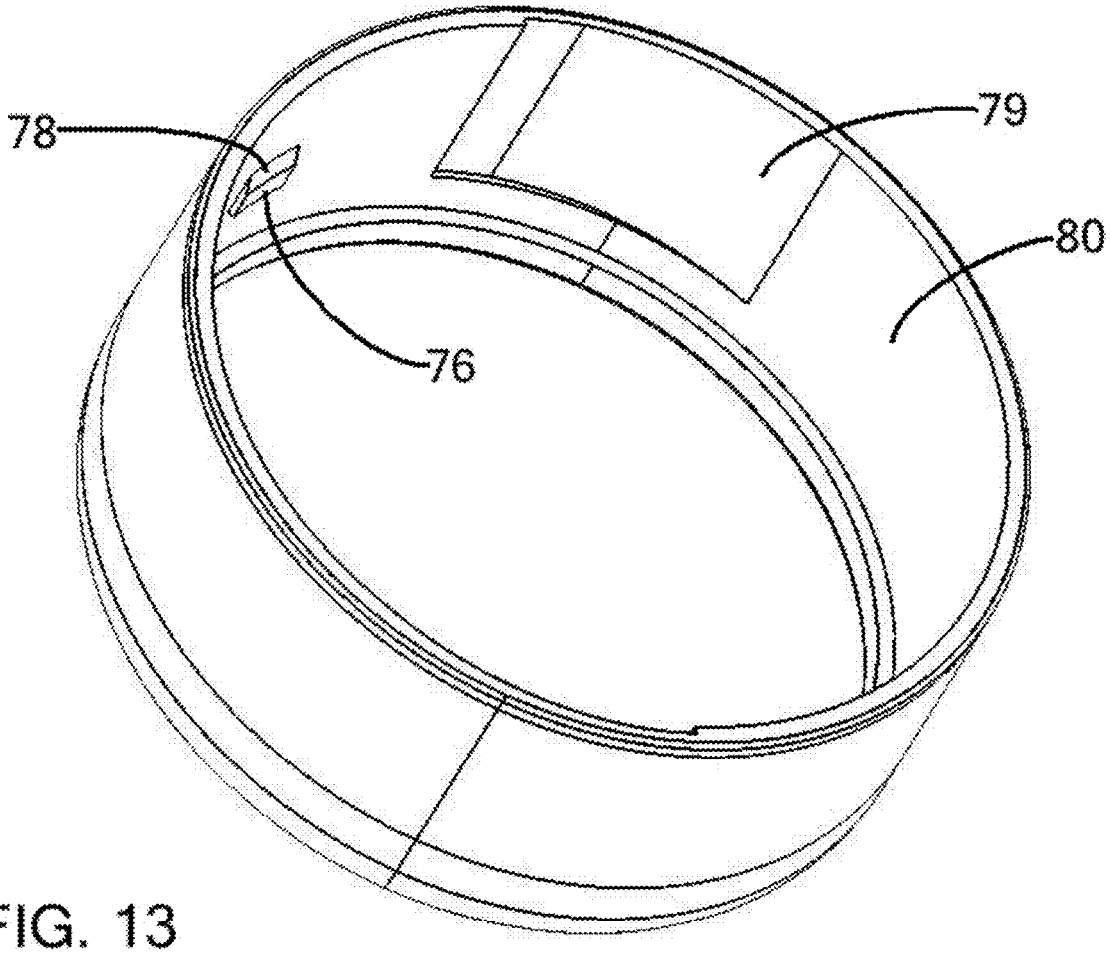
FIG. 13 illustrates another perspective view of the collet of FIG. 12.

In some embodiments, a bottom portion of the sleeve 20 may be configured with a movable tongue 68, separated from the remainder of the sleeve 20 by a channel 70. Further, the bottom portion of the sleeve 20 can further include a channel 66 formed along a portion of an outer circumference thereof. A raised portion 72 may communicate the channel 66 with the bottom of the sleeve 20. A collet 18, as shown in FIGS. 12 and 13, may fit onto the bottom of the sleeve 20, where an inside surface of the collet 18 can include a protrusion 76 having an upper sloped surface 78 and a ramped region 79. The protrusion 76 may be guided into the channel 66 by pressing the sloped surface 78 beyond the raised portion 72. The collet 18 may then rotate with the protrusion 76 sliding along the channel 66 during rotation thereof. The ramped region 79 may engage with the tongue 68 to cause the tongue 68 to move onto and out of an inside surface of the sleeve 20.

Thus, when the cup 12 is nested over the lower end 32, 32A of the bottle 22, 22A, and the sleeve 20 is assembled with the bottle 22, 22A, turning the collet 18 can cause the tongue 68 to press against the cup 12, holding the cup 12 in a stowed configuration. In should be understood that the collet may be optional and other mechanisms may be used to hold the cup 12 in the stowed position. Such mechanisms can include, for example, a bayonet lug, a twist lock, a friction fit, or the like. Regardless of specific mechanism, embodiments of the present invention permit storage of the cup so that the lower end 32, 32A of the bottle 22, 22A is disposed at least partially inside the cup 12.

Figure 14A:
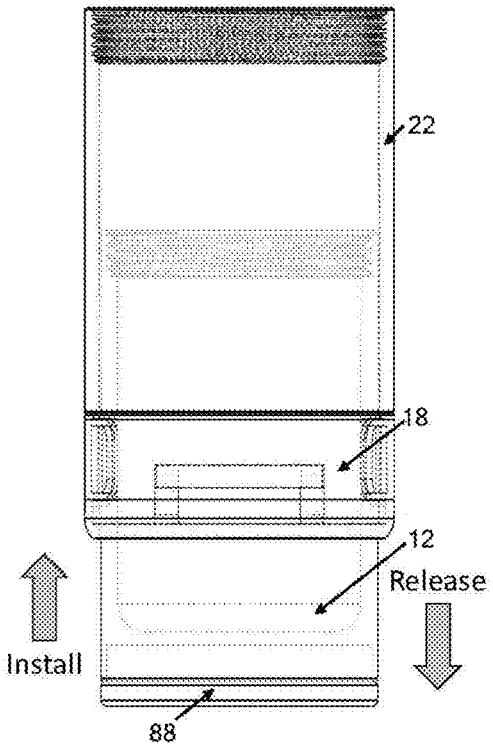
FIG. 14A is a side view of the cup partially removed from the beverage bottle.
Figure 14B:
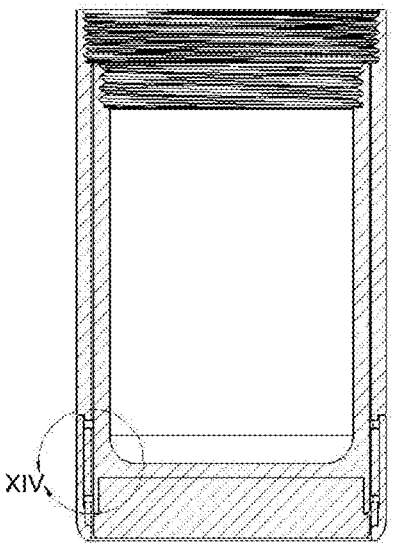
FIG. 14B is a cross-sectional side view of the cup nested about the beverage bottle.
Figure 14C:
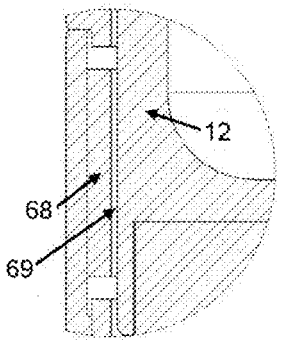
FIG. 14C is a detailed view taken along section XIV of FIG. 14A, showing the tongue of the sleeve spaced apart from the cup when the collet is turned in a cup release position.
Figure 15A:
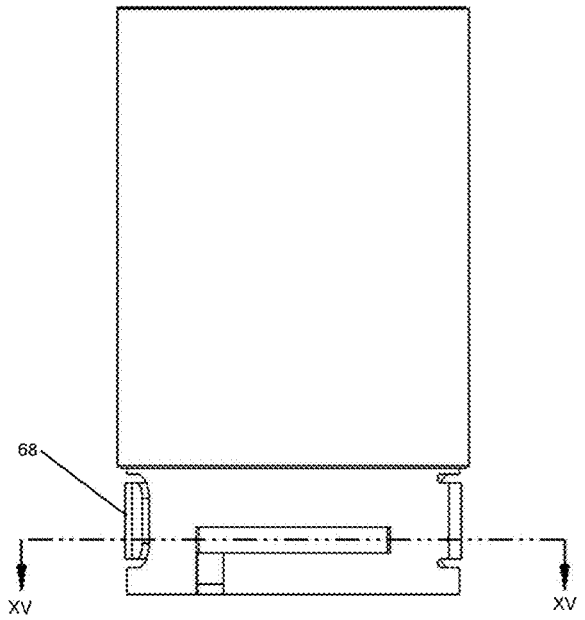
FIG. 15A is a side view of a sleeve of FIG. 10.
Figure 15B:
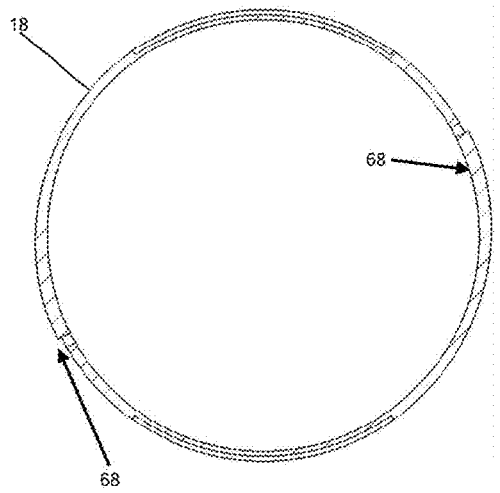
FIG. 15B is a cross-sectional view of the sleeve taken along line XV-XV of FIG. 15A, illustrating the tongue in a cup release position.
Figure 15C:
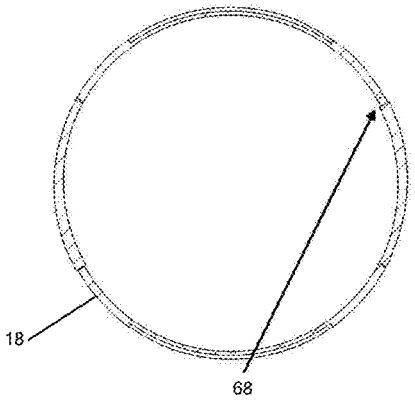
FIG. 15C is a cross-sectional view of the sleeve taken along line XV-XV of FIG. 15A, illustrating the tongue in a cup partially-secured position.
Figure 15D:
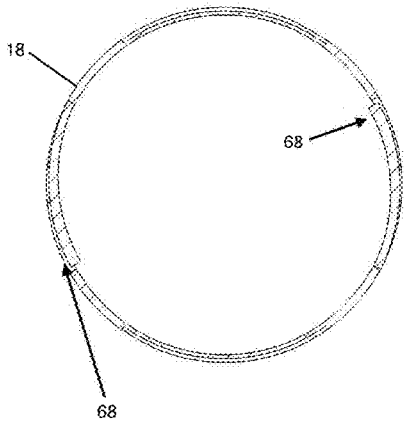
FIG. 15D is a cross-sectional view of the sleeve taken along line XV-XV of FIG. 15A, illustrating the tongue in a cup secured position.

Referring now to FIGS. 14A through 15D, the collet 18 may be turned with its protrusion 76 moving along the channel 66 to cause the tongue 68 to move between a cup-release position, where there is a space 69 between the cup 12 and the tongue 68 of the sleeve 20 as best illustrated in FIG. 14C. FIG. 15B illustrates this cup-release position, where the cup 12 may be gravity-released from its nested position about the beverage bottle. In FIG. 15C, the protrusion 76 may be in a middle position along the channel 66, where the tongue 68 is moved to slightly reduce the inside diameter of the sleeve 20. IN FIG. 15D, the protrusion 76 may be at a distal end of the channel 66, where the tongue 68 is depressed by the ramped region 79 of the collet 18 to cause the tongue 68 to press against the cup 12, retaining the cup in the nested position as shown in FIG. 15A.

Figure 16:
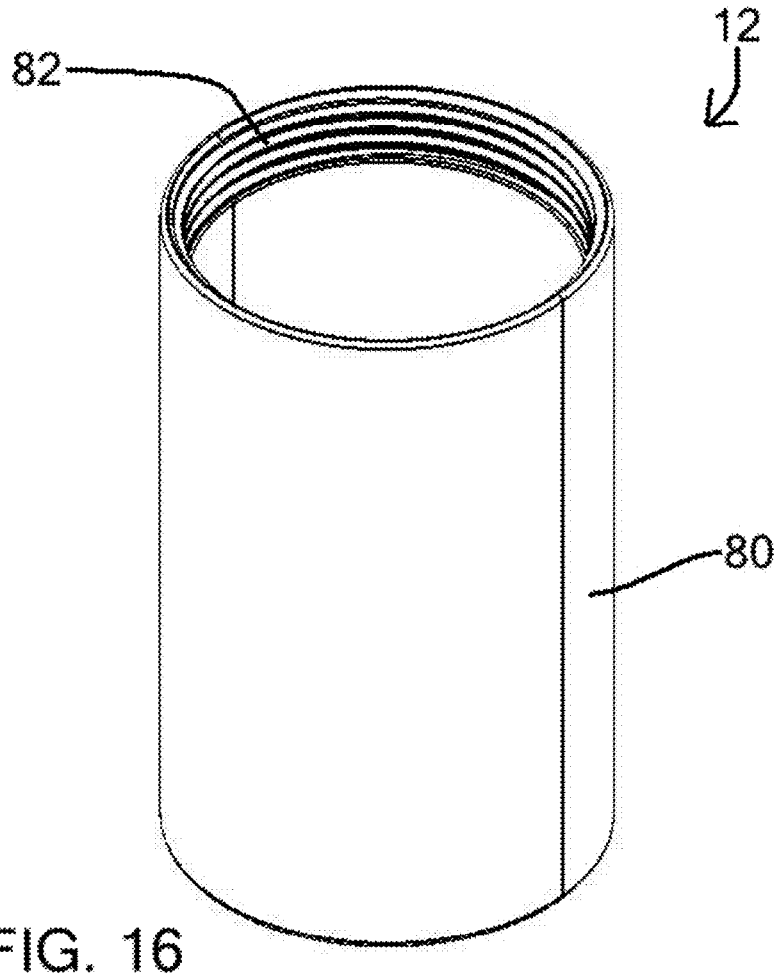
FIG. 16 illustrates a perspective view of the cup of FIG. 1.
Figure 17:
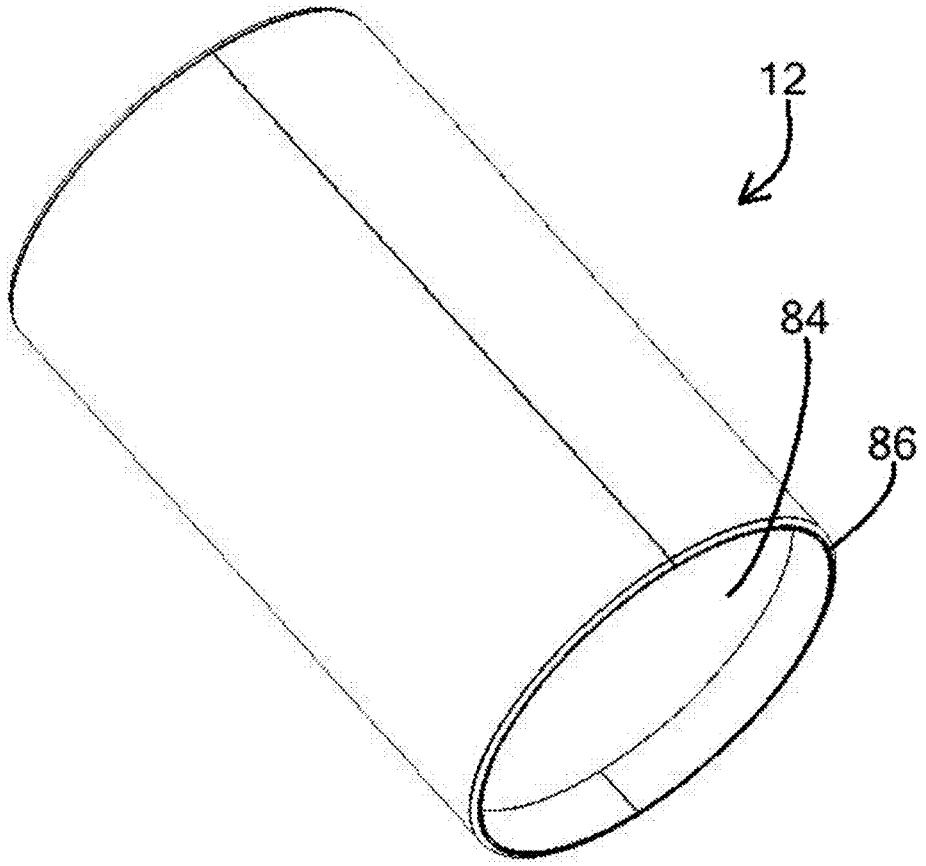
FIG. 17 illustrates a bottom perspective view of the cup of FIG. 16.

Referring to FIGS. 16 and 17, the cup 12 can include an outer surface 80 having an outer diameter that is smaller than an inside diameter of the sleeve 20. Female threads 82 may be disposed about an open top of the cup 12 to permit attachment of the cup cap 14. A base 84 of the cup 12 may be spaced away from the bottom 86 of the cup 12 such that a space is partially enclosed by the sides of the cup 12 at the bottom end thereof. A base member 88, as described in greater detail below, may be fit into this space at the bottom end of the cup 12.

Figure 18:
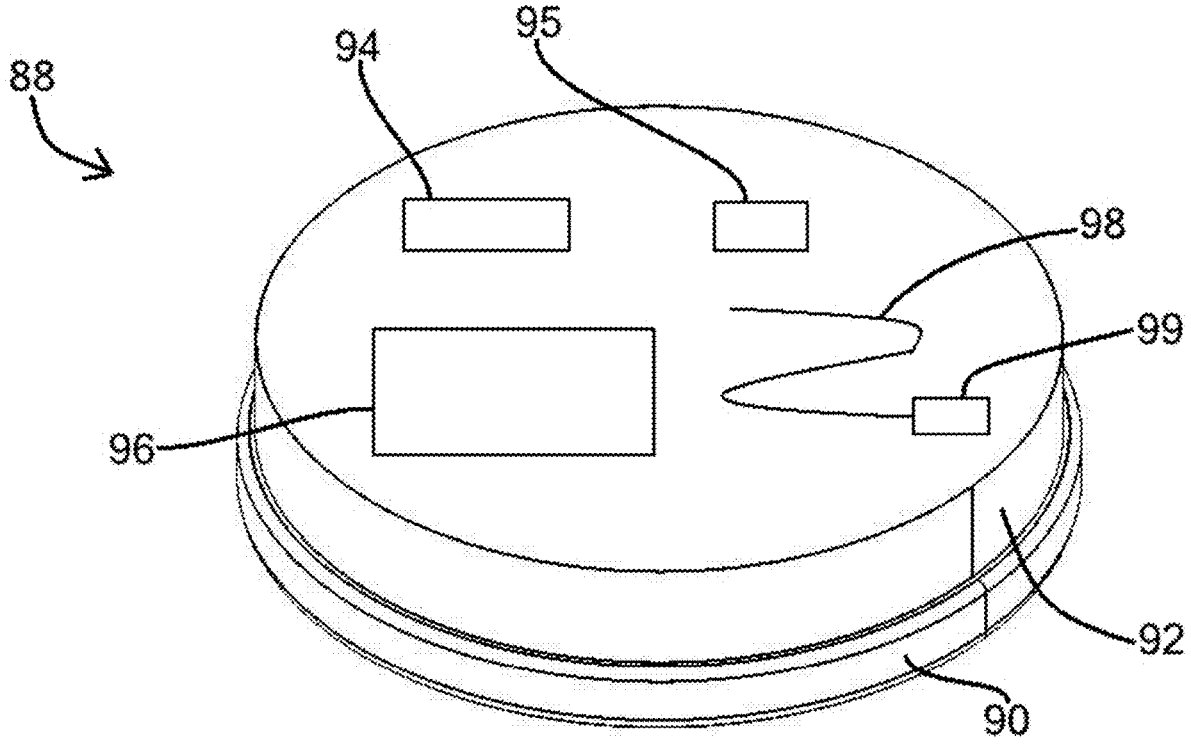
FIG. 18 illustrates a perspective view of a base member configured to fit onto a bottom of the cup of FIG. 16.

Referring to FIG. 18, the base member 88 of the cup 12 can include a reduced diameter portion 92 configured to fit into the space formed at the bottom of the cup 12. A larger diameter portion 90 may be configured to match the diameter of the cup 12, for example, and may extend below the bottom 86 of the cup 12 when assembled with the cup 12.

In some embodiments, the base member 88 can include electronic components, such as a battery pack 96 that may be charged via charge port 95. A cable (not shown) may connect the battery pack 96, via power port 94, to an electronic device to permit its charging. In some embodiments, a dongle 98 may be formed on an inner surface 97 of the base member 88, with a connector 99 formed on its end. The connector 99 may be designed to connect to an electronic device for its charging from the battery pack 96.

In some embodiments, the ports 94, 95 may be disposed on the inner surface 97 of the base member 88, thereby protecting the ports. However, in other embodiments, the ports 94, 95 may be disposed on the outside of the base member 88, thereby permitting electronic device charging without the need to remove the base member 88 from the cup 12.

Figure 19:
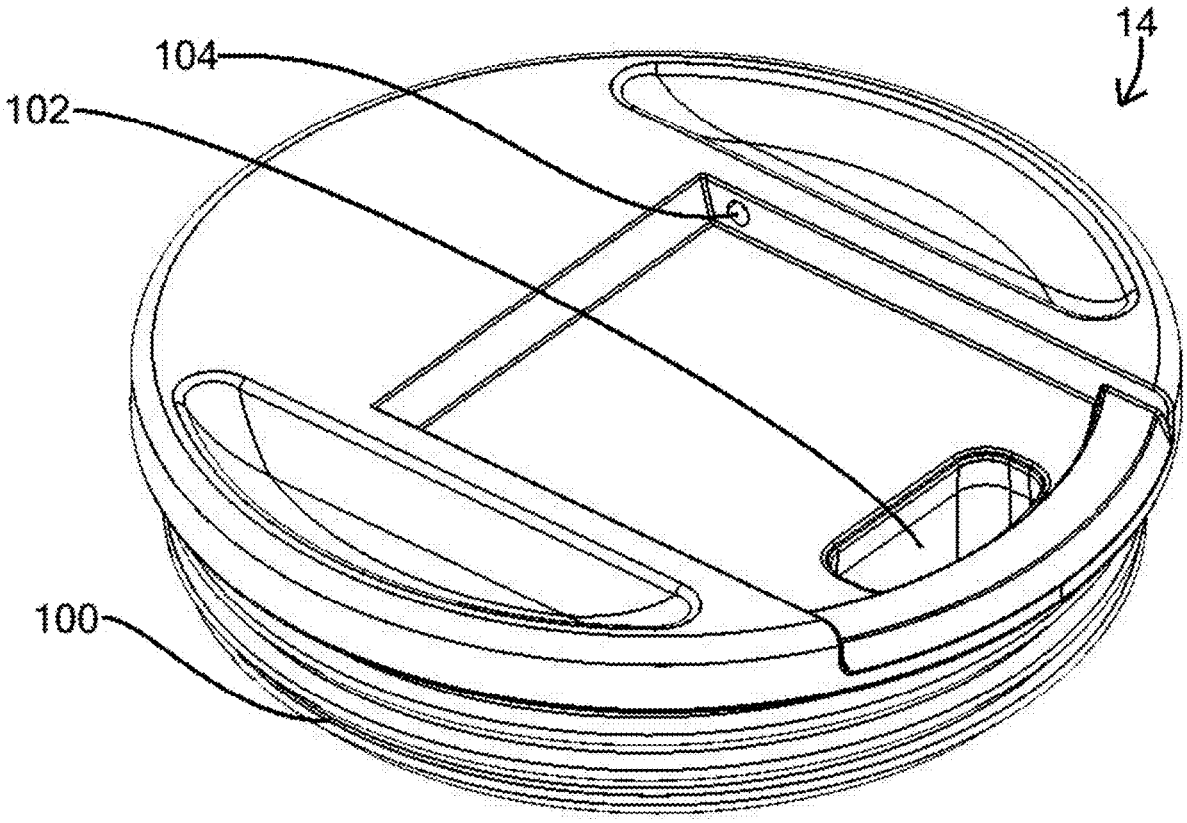
FIG. 19 illustrates a perspective view of a cup lid configured to fit onto a top of both the cup and the top of the beverage bottle caps of FIGS. 7 and 8.
Figure 20:
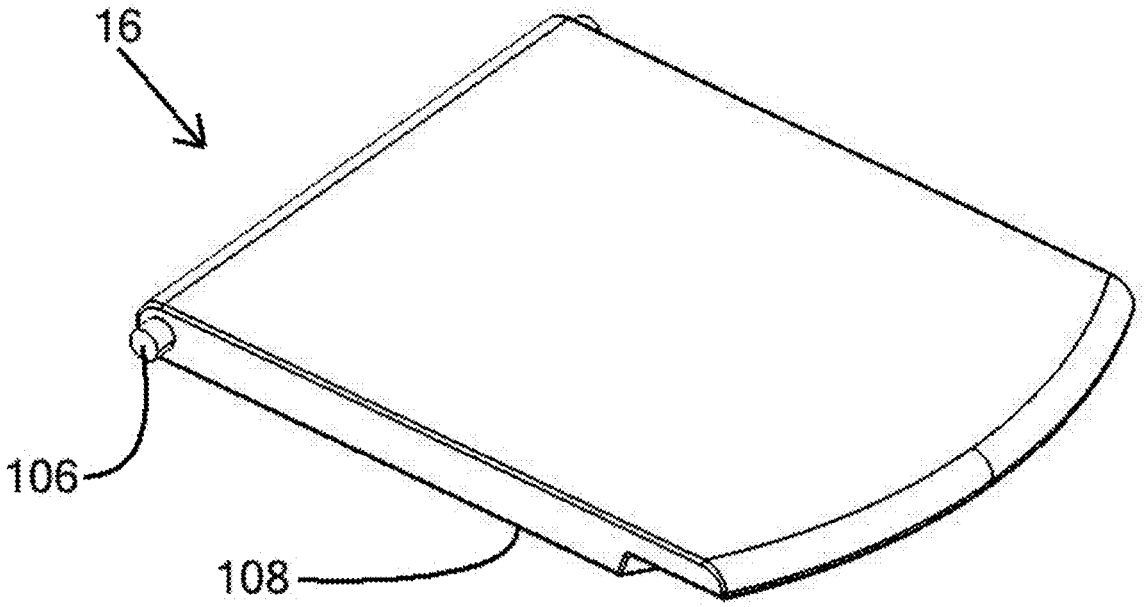
FIG. 20 illustrates a perspective view of a lid movable to permit access to fluid in the cup.

Referring to FIGS. 19 and 20, the cup cap 14 can include male threads 100 that may engage with the female threads 82 of the cup 12. A fluid port 102 may permit movement of fluid from the cup 12 to the user. A port cover 16 can have a sealing surface 108 that can selectively cover the fluid port 102 or be removed therefrom. In some embodiments, the port cover 16 can include pins 106 that engage with holes 104 in the cup cap 14 to permit pivoting of the port cover 16. While the Figures show one exemplary embodiment of the port and cover, it should be understood that various covers may be used to selectively cover the fluid port in the cup cap. For example, the cover could be a slide cover or the like.

Figure 21A:
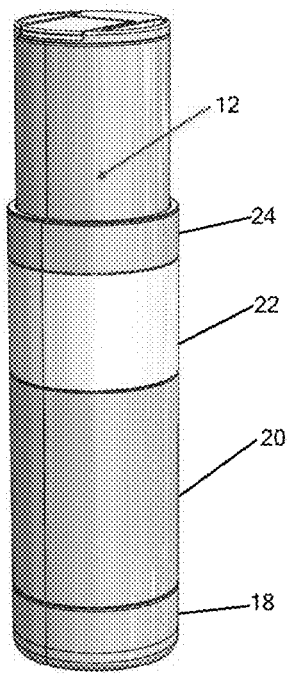
FIG. 21A is a side view showing the cup disposed on a top end of the beverage bottle according to an exemplary embodiment of the present invention.
Figure 21B:
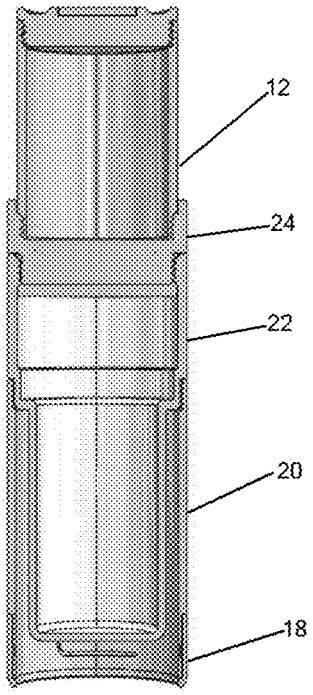
FIG. 21B is a cross-sectional view of the cup top-mounted configuration of FIG. 21A.

As discussed above, the cup 12 may be mounted at the top of the bottle cap 24, 24A. FIGS. 21A and 21B shows an example of such a configuration. Various mechanisms may be used to secure the cup 12 into the top of the bottle cap 24, 24A, including, but not limited to a friction fit, one or more magnets, a snap-fit, a twist lock, a tilt lock, a click-fit, or the like. Such a connection would be considered appropriate provided that the cup 12 may not readily fall out from the bottle cap 24, 24A, while the user may be able to remove the cup 12 (for placement into the stored, nested position, for example) without undue effort.

Figure 22A:
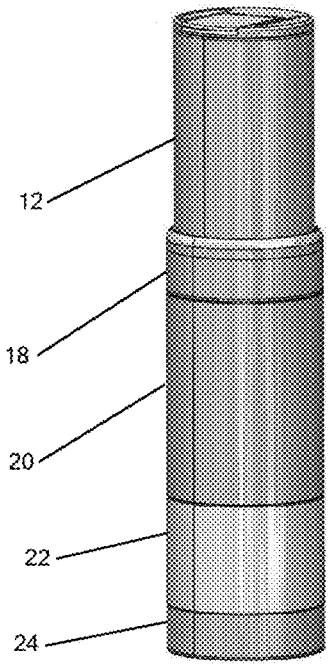
FIG. 22A is a side view showing the cup disposed on a bottom end of the beverage bottle according to an exemplary embodiment of the present invention.
Figure 22B:
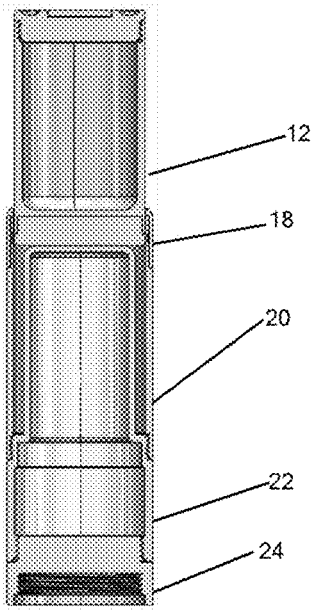
FIG. 22B is a cross-sectional view of the cup bottom-mounted configuration of FIG. 22A.

As discussed above, the cup 12 may be mounted from the bottom of the sleeve 20, typically retained by, for example, the action of the collet 18, as discussed above. Such a configuration is shown in FIGS. 22A and 22B. Other mechanisms for securing the cup 12 to the bottom of the sleeve 20 may be utilized, such as magnets, a twist lock, a friction fit, or the like.

It should be understood that while male and female threads have been described to provide connection between various members, other connection mechanisms may be used provided that the function remains. For example, the cup cap 14 may include a plurality of resilient sealing members that extend about its outer diameter (at a similar location of the male threads 100) that may be inserted into the cup 12 to frictionally sealingly engage therewith. In some embodiments, the threaded engagement between the sleeve 20 and the bottle 22, 22A may be either a different type of connection or may be replaced with a permanent connection.

As shown in the Figures, the outer diameter of the cup 12 may be constant about its length. Thus, once removed via the collet 18, the bottom of the cup 12 may be inserted into the sleeve 20 and the collet 18 tightened to attach the cup 12 to the bottom of the sleeve 20, where a user may drink from the cup 12, or close the port cover 16, turn the system 10 over, remove the bottle cap 24, 24A and drink from the bottle 22, 22A.

In some embodiments, the base member 88 or the bottom end of the cup 12 may be designed to fit into the top of the bottle cap 24, 24A once the cup cap 14 is removed therefrom and placed on the cup 12. Various connection mechanisms may be used to connect the base member 88 and/or the bottom of the cup 12 with the bottle cap 24, 24A, such as a friction fit, a threaded connection, a twist lock, a pin and slot, or the like. Regardless of the connection mechanism, once connected, a user can drink from the cup 12 by moving the cover 16 to reveal the fluid port 102 to permit fluid to pass from the cup 12. Further, the user can drink from the bottle 22, 22A by removing the bottle cap 24, 24A therefrom and drinking from the open end of the bottle 22, 22A. The bottle cap 24, 24A may be removed with or without removing the cup 12 from the bottle cap 24, 24A.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A container system comprising:

a bottle having an upper portion with an opening to access an interior thereof, and a lower portion extending from the upper portion, the lower portion having an outer diameter;

a sleeve attached to the bottle and extending about at least the lower portion of the bottle;

a space formed between the sleeve and the lower portion of the bottle;

a cup having an open end configured to receive at least a portion of the lower portion of the bottle to create a nested, stowed configuration, wherein, in the nested, stowed configuration, at least a portion of the cup is removably secured in the space;

a cup cap fixed to the container system in the nested, stowed configuration and removable from the container system to cover the cup when the cup is un-nested from the bottle; and an attachment member configured to retain the cup in the nested, stowed configuration, wherein the attachment member includes a collet formed about a portion of the sleeve, the collet being rotatable to cause a tongue to press against an outer surface of the cup when the cup is in the stowed, nested configuration.

2. The container system of claim 1, further comprising a bottle cap removably secured on the bottle to cover the opening thereof.

3. The container system of claim 1, further comprising a bottle cap removably secured on the bottle to cover the opening thereof, the bottle cap having an upper portion configured to store the cup cap.

4. The container system of claim 3, wherein the cup cap has threads mating with threads on (1) the cup to engage the cup cap with the cup; and (2) the upper portion of the bottle cap to engage the cup cap with the bottle cap during the nested, stowed configuration.

5. The container system of claim 1, wherein the bottle includes female threads about an inside of the opening, the female threads configured for attachment of a bottle cap thereto.

6. The container system of claim 1, wherein the bottle includes male threads about an outside of the opening, the male threads configured for attachment of a bottle cap thereto.

7. The container system of claim 1, wherein the sleeve attaches to the bottle with a threaded engagement therebetween.

8. The container system of claim 1, further comprising a base member disposed on a bottom end of the cup.

9. A container system comprising:

a bottle having an upper portion with an opening to access an interior thereof, and a lower portion extending from the upper portion, the lower portion having an outer diameter;

a sleeve attached to the bottle and extending about at least the lower portion of the bottle;

a bottle cap removably secured on the bottle to cover the opening thereof;

a space formed between the sleeve and the lower portion of the bottle;

a cup having an open end configured to receive at least a portion of the lower portion of the bottle to create a nested, stowed configuration, wherein, in the nested, stowed configuration, at least a portion of the cup is removably secured in the space;

a cup cap removably fixed to the bottle cap in the nested, stowed configuration and removable from the bottle cap, without requiring the bottle cap to be removed from the bottle, to cover the cup when the cup is un-nested from the bottle; and an attachment member configured to retain the cup in the nested, stowed configuration.

10. The container system of claim 9, wherein the cup cap has threads mating with threads on (1) the cup to engage the cup cap with the cup; and (2) the upper portion of the bottle cap to engage the cup cap with the bottle cap during the nested, stowed configuration.

11. The container system of claim 9, further comprising a base member disposed on a bottom end of the cup.

12. The container system of claim 11, wherein the base member has a battery pack formed therein, with one or more ports configured to charge an electronic device.

13. The container system of claim 9, wherein the bottle cap has an upper portion configured to store the cup cap.

14. The container system of claim 13, wherein the cup cap has threads mating with threads on (1) the cup to engage the cup cap with the cup; and (2) the upper portion of the bottle cap to engage the cup cap with the bottle cap during the nested, stowed configuration.

15. The container system of claim 9, wherein the sleeve attaches to the bottle with a threaded engagement therebetween.

16. A container system transformable between a stowed, nested configuration, and at least one deployed configuration, the container system comprising:

a bottle having an upper portion with an opening to access an interior thereof, and a lower portion extending from the upper portion; the lower portion having an outer diameter;

a sleeve attached to the bottle and extending about at least the lower portion of the bottle;

a bottle cap removably secured on the bottle to cover the opening thereof;

a space formed between the sleeve and the lower portion of the bottle;

a cup having an open end configured to receive at least a portion of the lower portion of the bottle to create the nested, stowed configuration, wherein, in the nested, stowed configuration, at least a portion of the cup is removably secured in the space and surrounded by the sleeve;

a cup cap removably fixed to the bottle cap in the nested, stowed configuration and removable from the bottle cap, without requiring the bottle cap to be removed from the bottle, to cover the cup when the cup is un-nested from the bottle; and an attachment member configured to retain the cup in the nested, stowed configuration, wherein a first deployed configuration is created by removably attaching a bottom portion of the cup with a top portion of the bottle cap after removing the cup cap therefrom; and a second deployed configuration is created by inserting the bottom portion of the cup into a lower end of the sleeve and actuating the attachment member to secure the bottom portion of the cup to the lower end of the sleeve.

17. A container system comprising:

a bottle having an upper portion with an opening to access an interior thereof, and a lower portion extending from the upper portion; the lower portion having an outer diameter;

a sleeve attached to the bottle and extending about at least the lower portion of the bottle;

a space formed between the sleeve and the lower portion of the bottle;

a cup having an open end configured to receive at least a portion of the lower portion of the bottle to create a nested, stowed configuration, wherein, in the nested, stowed configuration, at least a portion of the cup is removably secured in the space; and a base member disposed on a bottom end of the cup, wherein the base member has a battery pack formed therein, with one or more ports configured to charge an electronic device.

* * * * *